US005531210A

United States Patent [19]

Meiser et al.

[11] Patent Number: 5,531,210

[45] Date of Patent: Jul. 2, 1996

[54] TOY GUN

[75] Inventors: Daniel G. Meiser, Butler, Ky.; Randolph C. Stewart, Cincinnati, Ohio

[73] Assignee: Hasbro, Inc., Pawtucket, R.I.

[21] Appl. No.: 340,504

[22] Filed: Nov. 16, 1994

[51] Int. Cl.[6] ..... F41B 11/14; F41B 11/18

[52] U.S. Cl. ..... 124/66; 124/67

[58] Field of Search ..... 124/65, 66, 67

[56] References Cited

U.S. PATENT DOCUMENTS

| | | | |
|---|---|---|---|
| 754,051 | 3/1904 | Craven | 124/67 |
| 953,426 | 3/1910 | Mills . | |
| 1,065,556 | 6/1913 | Searle | 124/67 |
| 1,310,644 | 7/1919 | Austin . | |
| 1,760,652 | 5/1930 | Loomis | 124/67 |
| 1,856,285 | 5/1932 | LeFever . | |
| 2,725,869 | 12/1955 | Barber . | |
| 3,370,581 | 2/1968 | Hills et al. | 124/67 |
| 3,859,977 | 1/1975 | Lange . | |
| 3,951,038 | 4/1976 | Van Langenhoven | 124/67 |
| 4,665,622 | 5/1987 | Idan . | |
| 4,848,307 | 7/1989 | Tsao . | |

*Primary Examiner*—Dave W. Arola
*Assistant Examiner*—John A. Ricci
*Attorney, Agent, or Firm*—Kurt R. Benson

[57] ABSTRACT

A toy gun includes a housing, a forwardly biased plunger assembly in the housing, first and second rack gears in the housing, and a transmission gear assembly in the housing. The transmission gear assembly is operative for communicating rearward movement of the second rack gear to the first rack gear in order to move the first rack gear and the plunger assembly into rearward cocked positions in the housing. The transmission gear assembly is adapted so that once the first rack gear and the plunger assembly have been moved to the cocked positions thereof in housing, the second rack gear is freely movable without interference from the transmission gear assembly and the first rack gear, and so that the first rack gear and the plunger assembly are freely releasable to the uncocked positions for causing the plunger assembly to produce a blast of compressed air in order to launch a projectile from the housing.

5 Claims, 5 Drawing Sheets

TOY GUN

BACKGROUND AND SUMMARY OF THE INVENTION

The instant invention relates to toy guns, and more particularly to a spring powered toy gun which is adapted for firing projectiles with blasts of compressed air.

A variety of different types of toy projectile launchers and guns have been heretofore available, including various guns and projectile launchers which have been capable of launching projectiles with compressed air. In this regard, the U.S. Patents to Mills, U.S. Pat. No. 953,426; Austin, U.S. Pat. No. 1,310,644; LeFever, U.S. Pat. No. 1,856,285; Barber, U.S. Pat. No. 2,725,869; Lange, U.S. Pat. No. 3,859,977; Idan, U.S. Pat. No. 4,665,622; and Tsao, U.S. Pat. No. 4,848,307, disclose exemplary guns and projectile launchers which are believed to represent the closest prior art to the subject invention of which the Applicants are aware. However, the prior art has failed to provide a toy gun having a rack gear operating mechanism of the type included in the toy gun of the instant invention; and hence, the prior art devices, including those disclosed in the above-cited references, are believed to be of only general interest with respect to the toy gun of the subject invention.

The instant invention provides a toy gun having a unique, highly effective and realistic operating mechanism which therefore represents a significant improvement over the heretofore available toy guns and projectile launchers. More specifically, the instant invention provides a toy gun having a dual rack and pinion gear cocking mechanism which is adapted to enable a user to quickly and effectively move an air piston in the gun to a cocked position against the force of a biasing spring. Accordingly, the gun is adapted to be easily moved to a cocked position, and by thereafter releasing the air piston, the gun is operative for producing a blast of compressed air for launching a projectile from the forward end of the gun.

Still more specifically, the toy gun of the instant invention includes a housing, a plunger which is movable between cocked and uncooked positions in the housing, a first rack gear connected to the plunger for a movement therewith, a second rack gear which is manually movable between first and second positions in the housing, and a transmission gear assembly which is operative for communicating manual movement of the second rack gear to the first rack gear such that movement of the second rack gear from the first position thereof to the second position thereof causes movement of the plunger from an uncocked position in the housing to a cocked position. The plunger is adapted so that it is operative for producing a blast of compressed air for launching a projectile from the housing when the plunger is moved from the cocked position thereof to the uncocked position thereof, and accordingly, the gun of the instant invention is operative by first moving the second rack gear from the first position thereof to the second position thereof and by then releasing the plunger from the cocked position thereof to fire a projectile from the housing. The first and second rack gears are preferably mounted in substantially parallel relation in the housing, and the transmission gear assembly is preferably operative for communicating movement between the first and second rack gears so that when the plunger assembly is in the uncocked position thereof, the first and second rack gears move together and in the same direction as the second rack gear is manually moved toward the second position thereof. Further, the transmission gear assembly is preferably adapted so that the second rack gear is manually returnable to the first position thereof without causing corresponding movement of the first rack gear when the plunger assembly is in the cocked position. The toy gun preferably comprises a cylinder, and the plunger assembly preferably comprises a piston which travels in the cylinder for producing a blast of compressed air to launch a projectile from the housing upon movement of the plunger from the cocked position thereof to the uncocked position thereof. The housing preferably has longitudinally extending slots on transversely opposite sides thereof, and the gun preferably further comprises a pair of handles which travel in the slots for moving the second rack gear between the first and second positions thereof.

It has been found that the toy gun of the instant invention has significant advantages over the heretofore available toy guns. Specifically, it has been found that the first and second rack gears provide an effective mechanism for quickly and easily moving the plunger assembly to a cocked position. It has been further found that because the second rack gear can be freely returned to the first position thereof once the plunger assembly has been moved to a cocked position, the second rack gear and the associated handles are not normally moved during a firing operation so that the risk of injury to an operator of the gun is significantly reduced.

Accordingly, it is a primary object of the instant invention to provide an effective cocking mechanism for a toy gun.

Another object of the instant invention is to provide a cocking mechanism for a toy gun comprising first and second rack gears and a transmission gear assembly which connects the first and second rack gears so that they are operable for effectively moving a plunger to a cocked position against the force of a biasing spring.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
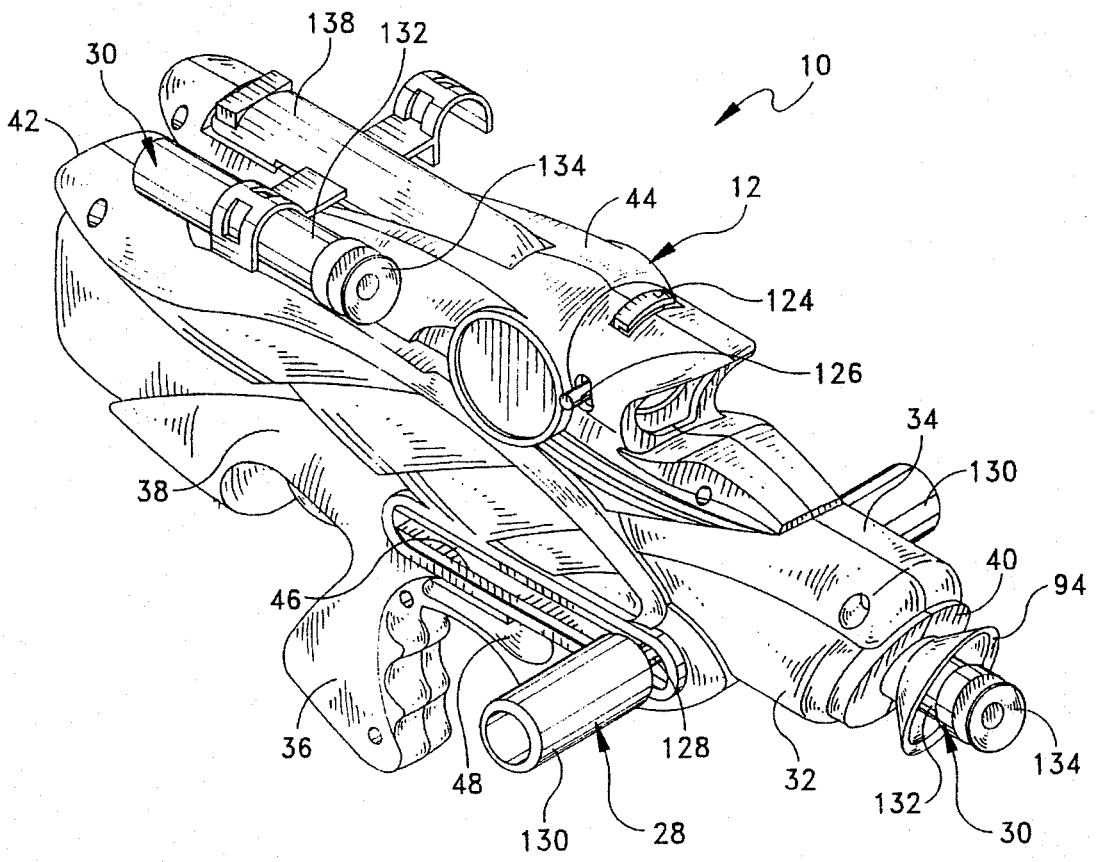
FIG. 1 is a perspective view of the toy gun of the instant invention.
Figure 2:
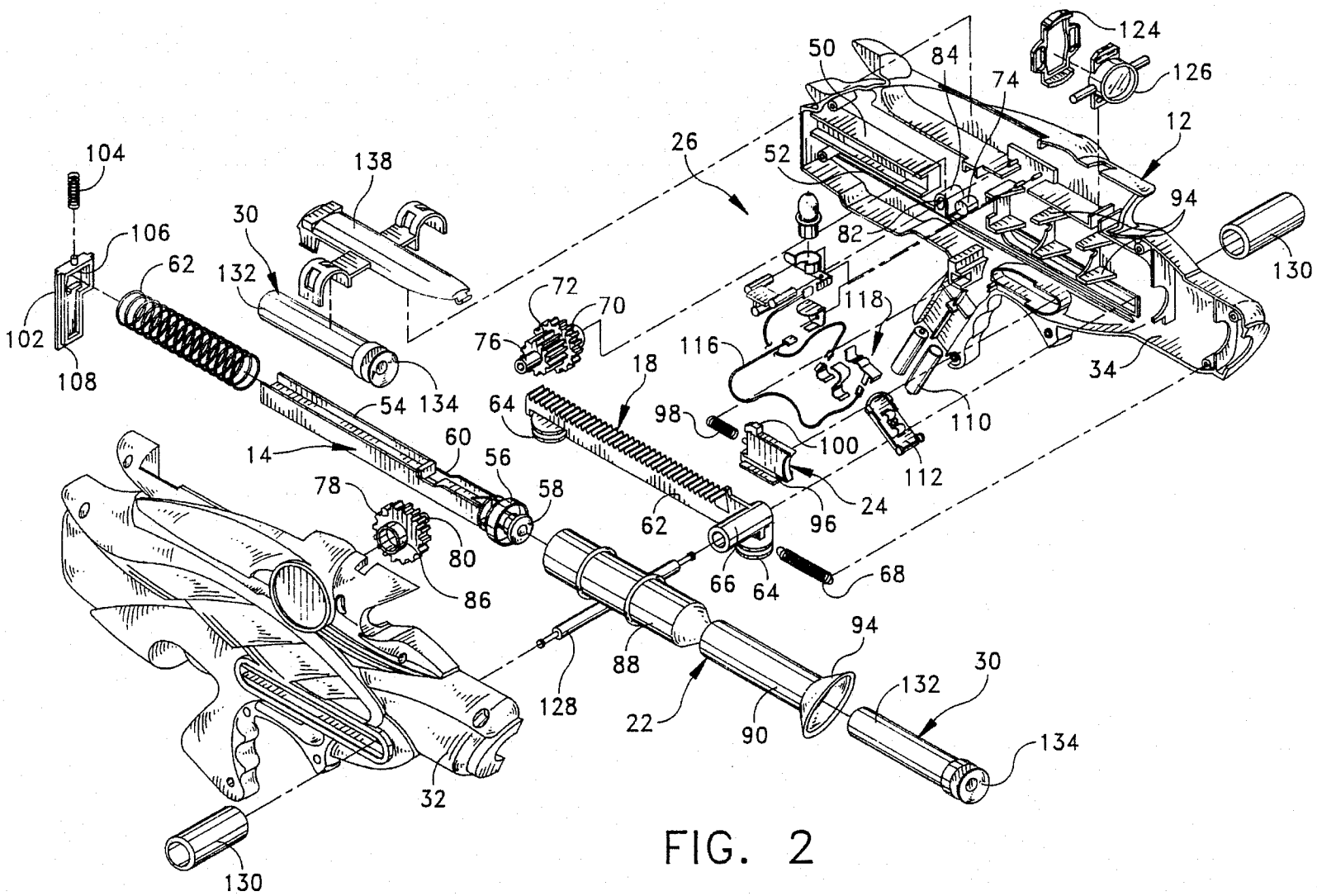
FIG. 2 is an exploded perspective view thereof.

Referring now to the drawings, the toy gun of the instant invention is illustrated and generally indicated at 10 in FIGS. 1–5. The toy gun 10 comprises a housing generally indicated at 12, a plunger assembly generally indicated at 14, a first rack gear 16, a second rack gear generally indicated at 18, and a transmission gear assembly generally indicated at 20. The toy gun 10 further comprises a launching tube generally indicated at 22, a trigger assembly generally indicated at 24, a target light assembly generally indicated at 26, and a handle assembly generally indicated at 28. The toy gun 10 is operable by means of the handle assembly 28 for moving the plunger 14 from an uncocked position to a cocked position in the housing 12, and the trigger assembly 24 is operative for releasing the plunger 14 to deliver a blast of compressed air to the launching tube 22 in order to launch a projectile 30 therefrom. Further, the trigger assembly 24 is adapted so that as it is operated for releasing the plunger 14, it operates to first actuate the target light assembly 26 in order to produce a concentrated light beam which is directed toward a proposed target area.

The housing 12 is preferably formed in the configuration of a futuristic gun, and it includes a pair of housing halves 32 and 34. The housing halves 32 and 34 are formed so that the housing 12 includes a handle portion 36, a main body portion 38 having a front end 40 and a rear end 42, and an upper light housing section 44. A longitudinally extending slot 46 is formed in each of the housing sections 32 and 34, and a trigger area 48 is formed in the body portion 38 adjacent the handle portion 36. As illustrated in FIGS. 2–5, the interior of the housing 12 is formed so as to include a plunger track 50 and a rack gear guide ridge 52, as well as a number of other mounting walls and bosses for mounting the operative components of the gun 10 in the interior of the housing 12.

Figure 3:
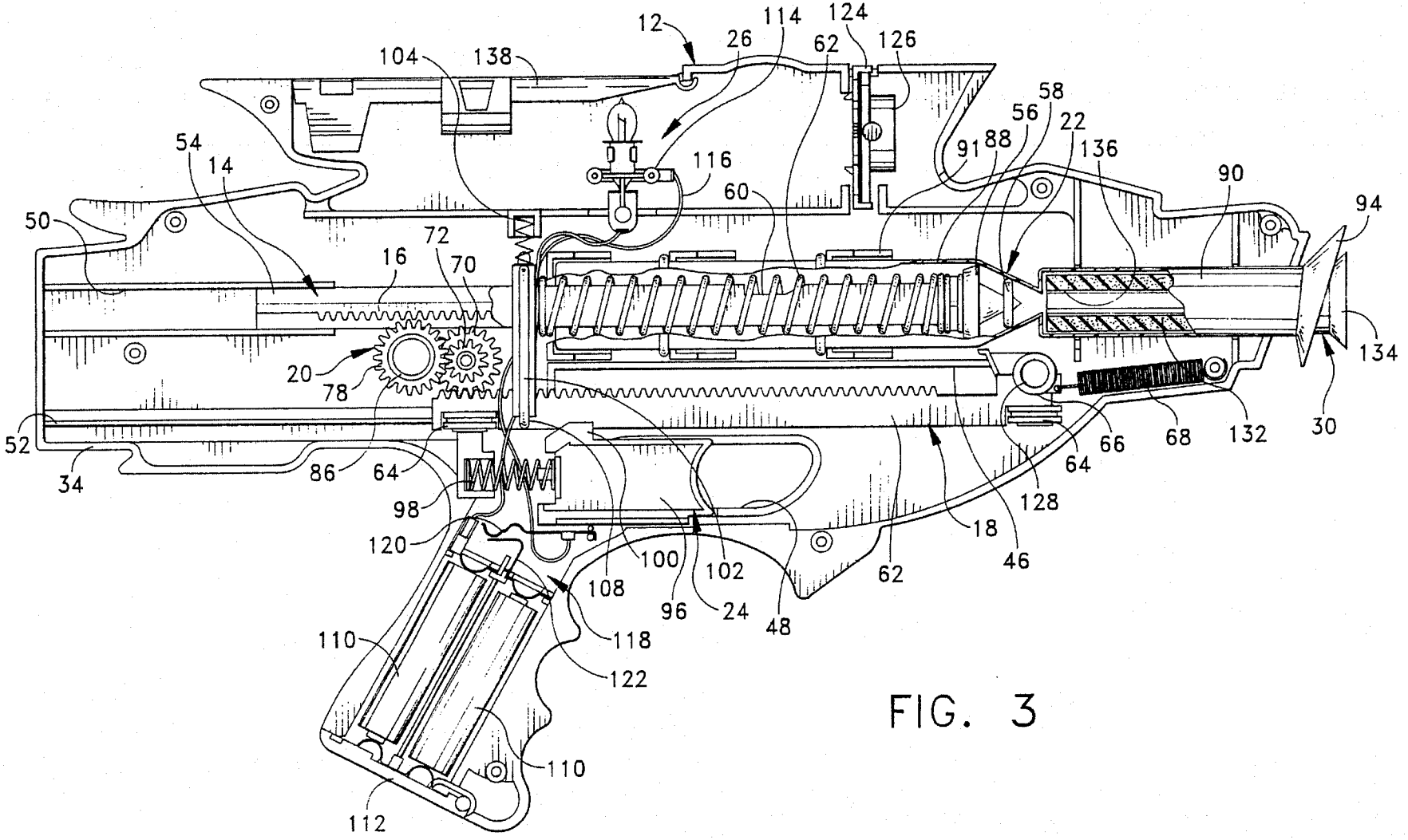
FIGS. 3 through 5 are sectional views illustrating the operation of the toy gun.
Figure 4:
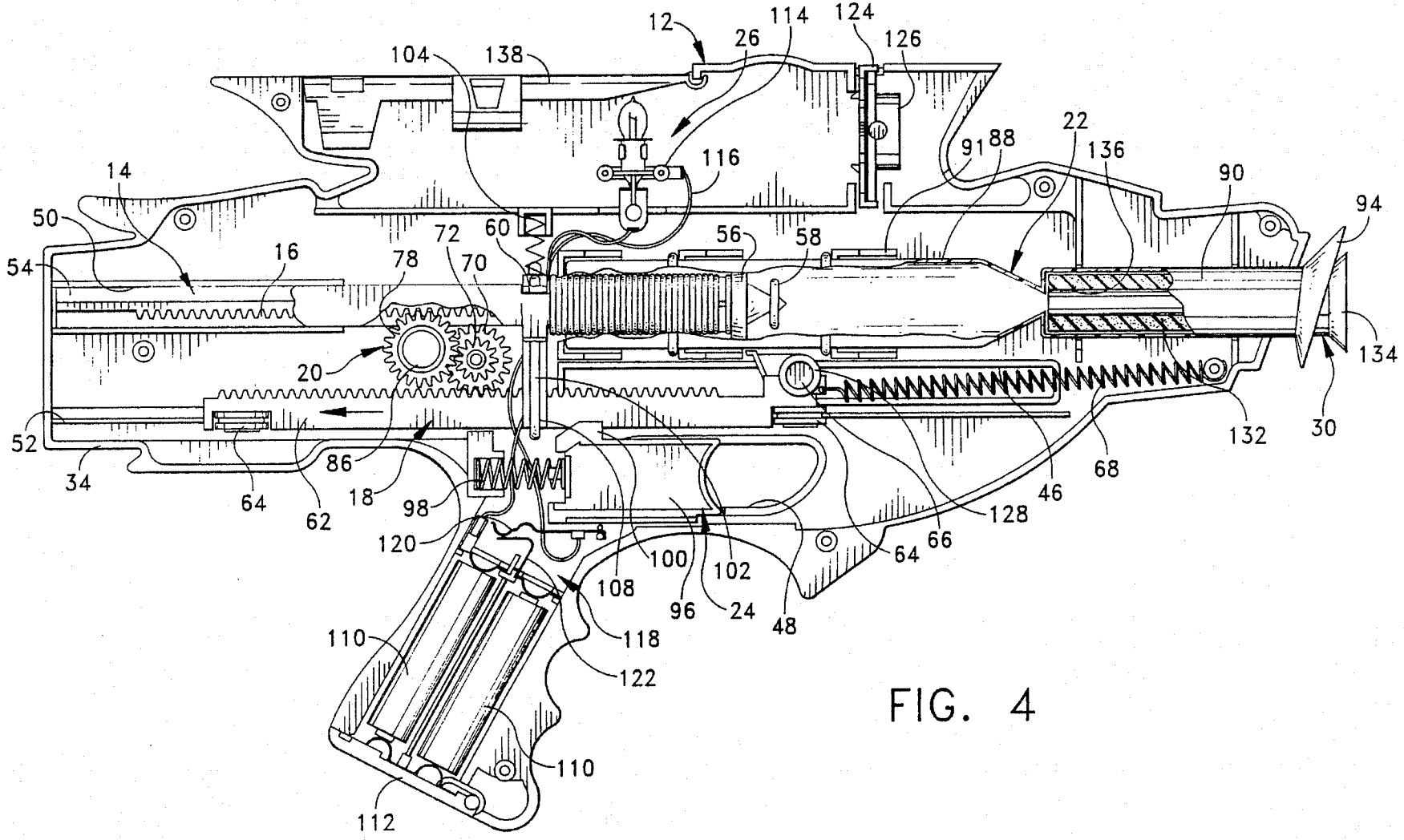
Figure 5:
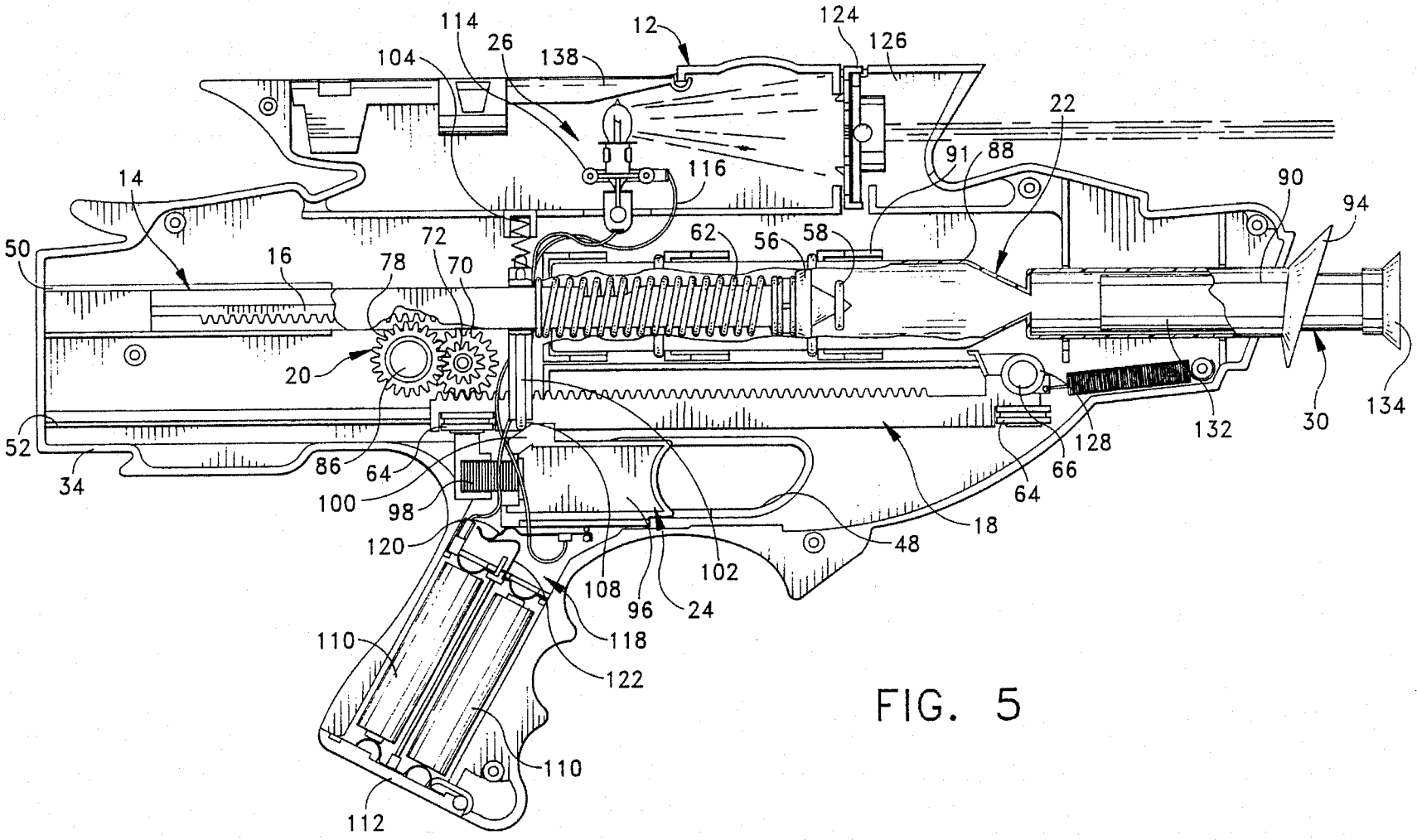

The plunger assembly 14 comprises an elongated plunger element 54 having a seal 56 and an impact absorber 58 received on one end thereof and a cocking notch 60 which is formed at an intermediate point in the extent of the plunger element 54. The plunger assembly 14 further comprises a coil spring 62 which is received on the forward portion of the plunger element 54 between the seal 56 and the notch 60. As illustrated in FIGS. 3–5, the first rack gear 16 is integrally formed on the under side of the plunger element 54 so that it extends from the notch 60 to a point adjacent the rear terminal end of the plunger element 54. The forward portion of the plunger element 54 is adapted to travel in the rear or cylinder portion of the launching tube assembly 22 so that the seal 56 provides an airtight seal between the plunger element 54 and the cylinder portion of the launching tube as the plunger element 54 is advanced forwardly therein. The impact absorber 58 is adapted to cushion the impact of the forward end of the cylinder portion of the launching tube 22 when the plunger element 54 reaches the forwardmost point in its travel as will hereinafter be more fully set forth. As illustrated in FIGS. 3–5, the plunger element 54 is received in the plunger track 50 so that it is longitudinally movable in the housing 12 between the rearward or cocked position illustrated in FIG. 4 and the released or uncocked position illustrated in FIG. 3.

The second rack gear 18 includes a second rack gear element 62 and a pair of mounting rollers 64 which are rotatably mounted adjacent opposite ends of the rack gear element 62. The rollers 64 are received on the ridge 52 for movably mounting the second rack gear 18 in the housing 12 in downwardly spaced, transversely offset, substantially parallel relation to the plunger assembly 14 and the first rack gear 16. Integrally formed adjacent the forward end of the second rack gear element 62 is a transversely extending handle mounting tube 66 and a spring 68 extends between a boss in the interior of the housing 12 and the forward end of the second rack gear element 62 for returning the second rack gear 18 to a forward position in the housing 12.

The transmission gear assembly 20 is mounted in the housing 12 between the first rack gear 16 and the second rack gear 18 for communicating rearward movement of the second rack gear 18 to the first rack gear 16. The transmission gear assembly 20 comprises a first transmission gear 70 which is integrally formed with a reduced second transmission gear 72. The first and second transmission gears 70 and 72 are rotatably received on a circular mounting boss 74 in the second housing section 34, mad an integrally formed shaft 76 on the gears 70 and 72 is rotatably received in an appropriately formed mounting socket (not shown) in the first housing section 32. The first and second transmission gears 70 mad 72 are mounted in the housing so that the first transmission gear 70 is maintained in intermeshing engagement with the second rack gear 18 as illustrated in FIGS. 3–5. Also included in the transmission gear assembly 20 is a movable pinion gear 78 having a shaft 80 which is rotatably received in a vertically elongated opening 82 in a mounting boss 84 on the second housing section 34. The movable pinion gear 78 also includes a shaft 86 which is rotatably received in a similar vertically elongated opening in a boss (not shown) in the first housing section 32. The movable pinion gear 78 is mounted in the housing 12 so that it is always maintained in engagement with the second transmission gear 72. However, the movable pinion gear 78, which is transversely offset from the second rack gear 18, but aligned with the first rack gear 16, is vertically movable between engaged and disengaged positions with respect to the first rack gear 16. More specifically, the movable pinion gear 78 is mounted so that when it is rotated in a counterclockwise direction, as viewed in FIGS. 3–5, it is moved upwardly into engagement with the first rack gear 16, but so that when the movable pinion gear 78 is rotated in a clockwise direction as viewed in FIGS. 3–5, it is maintained in a downward disengaged position relative to the first rack gear 16. As a result, when the second rack gear assembly 18 is moved rearwardly in the housing 12 so that the first and second transmission gears 70 and 72 are rotated in clockwise directions, as illustrated in FIGS. 3–5, the movable pinion gear 78 is moved upwardly into engagement with the first rack gear 16 to cause rearward movement of the first rack gear 16 and the plunger assembly 14. As a result, when the second rack gear 18 is moved rearwardly in the housing 12, the transmission gear assembly 20 is moved into engagement with the first rack gear 16 to communicate rearward movement thereto so that thereafter the first and second rack gears 16 and 18 are moved rearwardly together. However, once the first rack gear 16 and the plunger assembly 14 have been secured in the cocked positions thereof, when the second rack gear 18 is thereafter moved in a forward direction, the movable pinion gear 78 is disengaged from the first rack gear 16 so that the second rack gear 18 is freely movable in a forward direction without interference from the transmission gear assembly 20 or the first rack gear 16.

The launching tube assembly 22 comprises a rear or cylinder portion 88 which is integrally formed with a forward launching tube element 90. The launching tube assembly 22 is mounted in a fixed position in the housing 12 by means of a plurality of mounting frames 91. The rearward or cylinder portion 88 is positioned and dimensioned so that it cooperates with the plunger assembly 14 in a piston and cylinder relation so that when the plunger assembly 14 is advanced in the cylinder portion 18, a blast of compressed air is passed from the cylinder portion 88 into the launching tube element 90 for launching a projectile 30 therefrom. Specifically, when the plunger assembly 14 is advanced in a forward direction in the cylinder portion 88 by the spring 62, the seal 56 travels along the inner wall of the cylinder portion 88 in order to compress the air in the cylinder portion 88 as the plunger element 14 is advanced in a forward direction. The seal 56, on the other hand, seals the forward end of the cylinder portion 88 once the plunger assembly 14 reaches the end of its forward travel. The launching tube element 90 which extends integrally from the rear cylinder portion 88 is adapted and dimensioned for receiving a projectile 30 therein, and [he forward end of the launching tube element 90 includes a flared tip portion 94 which facilitates the loading of a projectile 30 in the launching tube element 90.

The trigger assembly 24 includes a trigger element 96 which is adapted to travel in the trigger opening 48 in the manner illustrated. The trigger element 96 is biased to a forward position with a spring 98, and it includes an upper cam section 100. The trigger assembly 24 further comprises a .release latch 102 which is slidably mounted in a vertical position in the housing 12 and biased toward a downward position therein with a spring 104. The release latch 102 has a rectangular opening 106 formed therein through which the plunger element 54 travels, and the release latch 102 is engageable with the plunger element 54 in the recess 60 for retaining the plunger assembly 14 and the first rack gear 16 in the cocked positions thereof illustrated in FIG. 4. The release latch 102 also includes a downwardly extending leg portion 108 which is engageable by the cam portion 100 for moving the release latch 102 upwardly in the housing 12 so as to disengage it from the plunger element 14. Accordingly, by pulling the trigger element 96 rearwardly against the spring 98, the cam portion 100 causes the release latch to be moved upwardly so that the plunger assembly 14 is moved from the cocked position thereof to the uncocked or released position thereof by the spring 62 in order to generate a blast of compressed air in the cylinder portion 88 which is transmitted to the launching tube portion 90 through the reduced tube element 92.

The target light assembly 26 comprises a pair of batteries 110 which are contained in the handle portion 36 with a compartment door 112. The target light assembly further includes a lightbulb and socket assembly 114 which is mounted in the upper target light housing section 44, a plurality of wires 116, and a contact assembly 118. The contact assembly 118 includes a first contact 120 which is resiliently deflectable into a contacting position with a second contact 122 by drawing the trigger 96 rearwardly in the opening 48. Specifically, the first contact 120 is constructed so that it is engageable by the rear extremity of the trigger element 96 to deflect the first contact element 120 downwardly into engagement with the second contact 122 in order to complete a circuit through the batteries 110 and the lightbulb assembly 114. As a result, when the trigger 96 is moved rearwardly, it engages the first contact 120 to move it into engagement with the second contact 122 in order to illuminate the lightbulb assembly 114. Further, the trigger 96 and the first contact 120 are preferably formed so that the first contact 120 is moved into engagement with the second contact 122 before the cam element 100 disengages the release latch 102 from the plunger element 54. As a result, the target light assembly 26 can be effectively utilized for illuminating a desired target area prior to launching a projectile 30 from the launching tube element 90. The target fight assembly 26 further comprises a lens holder element 124 which is received in the target light portion 44 of the housing 12 so that it is vertically adjustable therein and a lens element 126 which is mounted in the lens holder portion 124 so that it is transversely adjustable therein. Accordingly, by adjusting the positions of the lens holder 124 and the lens element 126, the position of the lens element 126 relative to the launching tube 90 can be adjusted so that light from the target light assembly 126 is focused along a path which corresponds to the actual trajectory of a projectile 30 as it is launched from the launching tube 90.

The handle assembly 28 comprises a rod portion 128 which is received in the mounting tube 66 so that it extends transversely through the housing 12 and outwardly through the slots 46 therein. The handle assembly 28 further comprises a pair of handle elements 130 which are received on opposite ends of the rod 128 so that they are positioned in transverse relation adjacent opposite sides of the housing 12. Accordingly, the handle elements 130 are effectively positioned to enable them to be utilized for drawing the second rack gear 18 rearwardly in the housing 12 to effect corresponding rearward movement of the first rack gear 16 and the plunger assembly 14.

The projectile 30 preferably comprises a foam shaft portion 132 and a suction cup tip portion 134. The shaft portion 132 preferably has a reduced tubular opening 136 formed in the rear end thereof for receiving air therein, and the shaft portion 132 is dimensioned to be received in the launching tube section 90 in the manner illustrated in FIGS. 3 and 4. The gun 10 preferably further comprises a magazine rack 138 which is received on the upper rear portion of the housing 12 for storing additional projectiles 30 thereon.

Accordingly, for use and operation of the toy gun 10, a projectile 30 is assembled in the launching tube 90. The plunger element 14 is then moved rearwardly to the cocked position thereof by drawing one or both of the handle elements 130 rearwardly in order to move the second rack gear 18 rearwardly in the housing 12. Rearward movement of the second rack gear assembly 18 is communicated to the first rack gear assembly 16 through the transmission gear assembly 20, and when the first rack gear 16 and the plunger assembly 14 reach the cocked positions thereof, the release latch 102 is moved downwardly into engagement with the plunger element 54 in the recess 60 to maintain the plunger assembly 16 in the locked position thereof. The handle elements 130 are then released so that the second rack gear 18 is returned to a forward position and the gear 78 is disengaged from the first rack gear 16. By thereafter drawing the trigger element 96 rearwardly against the spring 98, the trigger element 96 first causes the movable contact 120 to be moved into engagement with a stationary contact 122 in order to actuate the target light assembly 26. The light produced by the target light assembly 26 can then be directed onto a desired target, and finally, by drawing the trigger element 96 further rearwardly, the cam portion 100 causes the release latch 102 to be disengaged from the plunger assembly 14 so that the plunger element 54 is propelled forwardly in the cylinder portion 88 by the spring 62. As a result, the plunger assembly 14 causes a blast of compressed air to be passed through the reduced tubular element 92 to launch the projectile 30 from the launching tube portion 90.

It is seen, therefore, that the instant invention provides an effective toy gun construction. The first and second rack gear assemblies 16 and 18, respectively, and the transmission gear assembly 20 provide an effective and convenient mechanism for drawing the plunger assembly 14 into a cocked or loaded position. Further, the target light assembly 26 provides an effective means for aiming the gun 20 towards a desired target. Accordingly, the toy gun of the instant invention is both convenient to operate and highly reliable in its operation, and it has significant advantages over the heretofore available toy gun constructions. As a result, the toy gun of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy gun comprising:

a housing having front and rear ends and having a pair of longitudinally extending slots in transversely opposite sides thereof;

plunger means in said housing movable between cocked and uncocked positions and operable for launching a projectile from said housing upon movement of said plunger means from the cocked position thereof to the uncocked position thereof;

first rack gear means connected to said plunger means for movement therewith and operable for moving said plunger means from the uncocked position thereof to the cocked position thereof;

releasable retaining means releasably retaining said plunger means in the cocked position thereof;

second rack gear means in said housing manually movable between first and second positions thereof;

transmission gear means communicating manual movement of said second rack gear means to said first rack gear means such that movement of said second rack gear means from the first position thereof to the second position thereof causes movement of said plunger means from the uncocked position thereof to the cocked position thereof; and a pair of handles traveling in said slots on opposite sides of said housing and communicating with said second rack gear means for moving said second rack gear means from the first position thereof to the second position thereof.

2. In the toy gun of claim 1, said first and second rack gear means being substantially parallel, said transmission gear means communicating movement from said second rack gear means to said first rack gear means such that said first and second rack gear means move together and in the same direction as said second rack gear means is manually moved toward the second position thereof until said plunger means is in the cocked position thereof.

3. In the toy gun of claim 1, said second rack gear means being manually returnable to the first position thereof when said plunger means is in the cocked position thereof.

4. In the toy gun of claim 1, said second rack gear means being freely manually returnable to the first position thereof without causing corresponding movement of said first rack gear means when said plunger means is in the cocked position thereof.

5. The toy gun of claim 1 further comprising cylinder means, said plunger means including a piston traveling in said cylinder means for producing a blast of compressed air for launching a projectile from said housing upon movement of said plunger means from the cocked position thereof to the uncocked position thereof.

* * * * *